United States Patent [19]

Brinkerhoff

[11] 4,307,572

[45] Dec. 29, 1981

[54] EXTERNALLY COOLED ABSORPTION ENGINE

[75] Inventor: VerDon C. Brinkerhoff, Salt Lake City, Utah

[73] Assignee: New Energy Dimension Corporation, Wilmington, Del.

[21] Appl. No.: 43,300

[22] Filed: May 29, 1979

Related U.S. Application Data

[63] Continuation-in-part of Ser. No. 906,269, May 15, 1978, abandoned.

[51] Int. Cl.[3] ..... F01K 25/06

[52] U.S. Cl. ..... 60/649; 60/689; 60/673; 122/39; 261/153; 261/155; 202/236; 203/23

[58] Field of Search ..... 60/649, 673, 689, 653, 60/676; 202/158, 159, 236; 203/23, 89; 122/39, 40; 261/153, 155

[56] References Cited

U.S. PATENT DOCUMENTS

| | | | |
|---|---|---|---|
| 337,371 | 3/1886 | Campbell | 60/649 |
| 453,444 | 6/1891 | Horack | 60/649 |
| 1,647,739 | 11/1927 | McDonnell | 122/39 X |
| 2,559,720 | 7/1951 | Hunter | 261/153 X |
| 3,505,810 | 4/1970 | Mamiya | 60/649 X |
| 4,183,218 | 1/1980 | Eberly, Jr. | 60/673 |

FOREIGN PATENT DOCUMENTS

| | | | |
|---|---|---|---|
| 2637864 | 3/1977 | Fed. Rep. of Germany | 60/653 |
| 294882 | 9/1929 | United Kingdom | 60/673 |

*Primary Examiner*—Allen M. Ostrager
*Assistant Examiner*—Stephen F. Husar
*Attorney, Agent, or Firm*—H. Ross Workman; J. Winslow Young; Allen R. Jensen

[57] ABSTRACT

An externally cooled, absorption engine apparatus and method, the apparatus including a closed cycle system having a first fluid and a second fluid, the first fluid constituting a working fluid and having a relatively lower boiling point while the second fluid constitutes a solvent for the first fluid and has a relatively higher boiling point and a relatively high degree of absorptivity for the first fluid. The apparatus further includes a distillation column, a superheater, a mechanical expansion engine, an externally cooled absorption column, and heat exchange apparatus. The distillation column separates the first fluid or working fluid from the solvent with heat energy supplied by an external combustion source and the superheater increases the thermal energy thereof prior to passing the working fluid through the mechanical expansion engine. The mechanical expansion engine converts thermal engine in the working fluid vapor to mechanical energy. Importantly, the backpressure to the mechanical expansion engine is significantly lowered by absorbing the working fluid with solvent from the distillation column and the efficiency of the same is substantially enhanced by cooling the solvent and also by removing heat of absorption through an external coolant source.

5 Claims, 2 Drawing Figures

EXTERNALLY COOLED ABSORPTION ENGINE

RELATED APPLICATIONS

This application is a continuation-in-part application of my co-pending application Ser. No. 906,269 filed May 15, 1978, now abandoned, for EXTERNALLY COOLED ABSORPTION ENGINE.

BACKGROUND

1. Field of the Invention

This invention relates to an external combustion engine apparatus and, more particularly, to a closed cycle, two-fluid, externally cooled, vapor standard engine apparatus and method.

2. The Prior Art

A conventional external combustion engine receives energy from an external combustion source to vaporize a single working fluid. The working fluid is utilized in an expansion engine apparatus where the thermal energy of the working fluid is converted to mechanical energy. In a closed cycle system, the working fluid is condensed after passing through the mechanical expansion engine and returned to the boiler where it is again vaporized. While certain savings are realized by returning the working fluid to the boiler, it is well-known that unless extensive condenser apparatus is provided, a substantial backpressure exists in the working fluid thereby lowering the efficiency of the mechanical expansion engine.

Dual fluid systems are known in the art and generally incorporate a lower boiling point working fluid and a higher boiling point solvent. The solvent is chosen so that it has a relatively high degree of absorptivity for the working fluid. One such system is the well-known ammonia/water system which is used for numerous applications, primarily in the field of refrigeration. However, until the present invention, none of the prior art systems has utilized a closed vapor standard heat engine to convert thermal energy into mechanical energy whereby the working fluid is distilled from a solution consisting of working fluid and solvent and thereafter superheated prior to being passed into the mechanical expansion engine. The exhausted working fluid is absorbed in solvent with the heat of absorption being recovered by an external cooling source.

It, therefore, would be a significant advancement in the art to provide a closed cycle, vapor standard heat engine for converting thermal energy from an external combustion source to mechanical energy utilizing a dual fluid system. It would also be an advancement in the art to provide a dual fluid system whereby a solvent fluid has a high degree of absorptivity for a working fluid and wherein the heat of absorption of the system is recovered through an external cooling source. Such a novel apparatus and method is disclosed and claimed herein.

BRIEF SUMMARY AND OBJECTS OF THE INVENTION

The present invention relates to a closed cycle, dual fluid, externally cooled, vapor standard engine which utilizes heat energy from an external combustion source to distill a working fluid from an absorption solution of working fluid in solvent. Additional heat energy is added to the vaporized working fluid in a superheater to thereby provide an expanded, high-pressure gas. The gas is expanded in a mechanical expansion engine thereby converting the thermal energy therein to mechanical energy. Backpressure of the system downstream of the mechanical expansion engine is significantly reduced by absorbing the working fluid with solvent from the distiller while recovering the heat of absorption therefrom thereby creating an unusually low backpressure in the system downstream of the mechanical expansion engine. The resulting solution is pumped through a countercurrent heat exchanger to remove heat energy from the solvent prior to introducing the solvent into the absorption apparatus and returning the solution to the distiller apparatus.

It is, therefore, a primary object of this invention to provide improvements in closed cycle, vapor standard heat engines.

Another object of this invention is to provide an improved method for converting thermal energy into mechanical energy.

Another object of this invention is to provide a closed cycle, vapor standard heat engine wherein a first, working fluid is vaporized in a distiller and superheated prior to being introduced into a mechanical expansion engine and the backpressure downstream of the mechanical expansion engine is reduced by absorbing the working fluid with solvent from the distiller apparatus.

Another object of this invention is to provide a closed cycle, vapor standard engine apparatus wherein thermal energy produced in the absorption apparatus is removed externally through a heat exchanger apparatus.

Another object of this invention is to provide a novel apparatus for absorbing working fluid downstream of the mechanical expansion engine and removing the heat of absorption generated thereby.

These and other objects and features of the present invention will become more fully apparent from the following description and appended claims taken in conjunction with the accompanying drawing.

DETAILED DESCRIPTION OF THE PREFERRED EMBODIMENTS

Figures 1, 2:
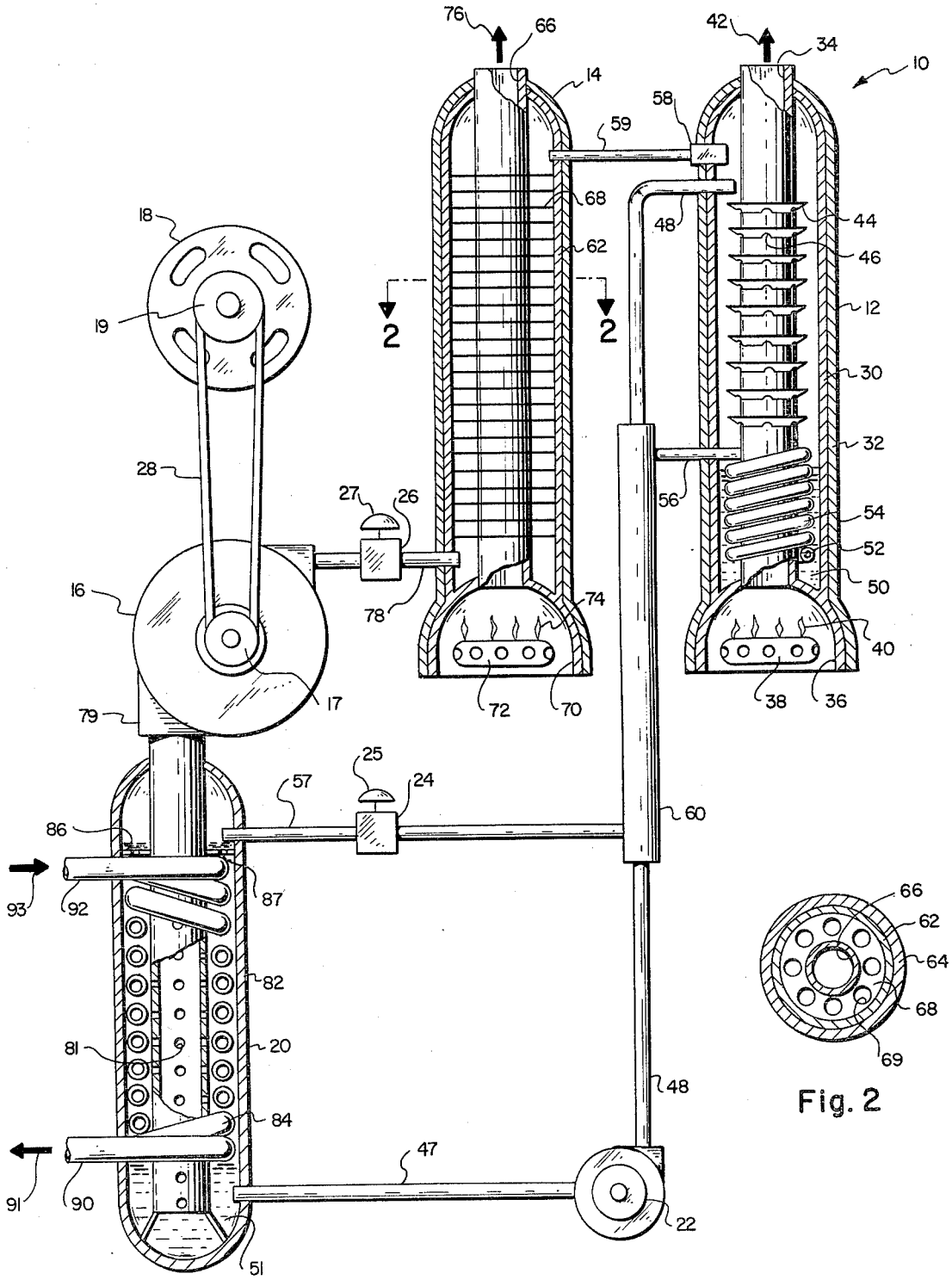
FIG. 1 is a schematic illustration of the apparatus of the present invention with portions shown in cross-section and also broken away for ease of illustration and understanding.
FIG. 2 is a cross-section taken along lines 2—2 of FIG. 1.

The invention is best understood by reference to the drawing wherein like parts are designated with like numerals throughout.

GENERAL DISCUSSION

Distillation is a well-known method for separating the various components of a solution. The process depends upon the distribution of all the substances therein between the gaseous phase and the liquid phase, and is applied to cases where both components are present in both phases. Distillation differs from absorption and desorption in that a new substance is not introduced into the mixture in order to provide the second phase. Instead, the new phase is created from the original solution by vaporization or condensation. Distillation is, therefore, concerned with the separation of solutions where all of the components are appreciably volatile. A well-known example in this category is the separation by distillation of the components of a liquid solution of ammonia (working fluid) and water (solvent). The application of heat to the solution results in a partial vaporization of the solution creating a gaseous phase consisting of water and ammonia, and since the gaseous phase will be richer in ammonia than in the residual liquid of the solution, a certain amount of separation will have resulted. By appropriate manipulation of the phases and/or by repeated vaporizations and condensations, it is ordinarily possible to make as complete a separation as may be desired thereby recovering both components of the original solution in as pure a state as desirable.

In distillation, therefore, the new phase differs from the original phase by its heat content. Heat may be readily added or removed without difficulty, however, of course, the cost in doing this must inevitably be considered. Much technical literature is available on multicomponent systems, particularly binary liquid-vapor equilibrium diagrams. The relationship between pressure, temperature, and composition of the mixture has been thoroughly studied and analyzed for numerous compositions. This is particularly true for the well-known ammonia/water systems.

In summary, therefore, distillation is conventionally achieved by distilling a combined dual fluid solution in an insulated, high-pressure distiller to produce the vapor (working fluid) from the absorption solution, leaving the solvent-rich second fluid (solvent) as a bottom product in the distiller. Heat energy is transferred into the solution to create the separation with the vaporized fluid being conducted through a one-way valve where it may be subjected to additional input of heat energy, as desired. For example, additional heat energy can be imparted to the vaporized working fluid by a superheater arrangement also utilizing heat energy from an external combustion source.

A conventional mechanical expansion engine apparatus may be utilized for the purpose of converting the thermal energy content of the heated working fluid vapor into mechanical energy. Numerous devices are utilized for this purpose and are provided primarily in the form of turbines, and the like. The mechanical energy derived therefrom may be used for various purposes including the generation of electrical energy. Importantly, an absorption apparatus is provided downstream of the mechanical expansion engine apparatus for the purpose of absorbing the working fluid therein and thereby substantially reduce the backpressure to the mechanical expansion engine for the purpose of enhancing the mechanical efficiency. The solubility of the working fluid into the solvent is generally determined by the partial pressures involved as well as the temperatures of the solutions. Accordingly, it is useful to lower the temperature of the solvent prior to introducing the solvent into the absorption apparatus. Additionally, it is well-known that the solution of a gas generally results in the evolution of heat so that it is useful to remove the thermal energy generated thereby to enhance the absorption of the working fluid in the solvent.

Referring now more particularly to FIG. 1, the externally cooled absorption engine apparatus of this invention is shown generally at 10 and includes a distiller 12, a superheater 14, a mechanical expansion engine 16, an absorption apparatus 20, and a heat exchanger 60. Additional equipment includes a generator 18, a pump 22, and control valves 24 and 26. Each of control valves 24 and 26 are controlled by controllers 25 and 27, respectively.

With particular reference to distiller 12, distiller 12 is fabricated as a cylindrical column 30 surrounded by an insulative sheath 32 and includes a coaxial flue 34 extending upwardly and in spaced relationship through column 30 from a combustion chamber 36. A burner 38 provides the necessary heat energy in combustion chamber 36 as indicated schematically by flames 40. The heat energy produced thereby is conducted upwardly through flue 34 where it is vented as cooled exhaust gas 42 to the atmosphere. Flue 34 thereby serves as a heat exchange surface for conducting the heat energy into the interior of column 30.

Column 30 is generally segregated into an upper distillation section and a lower, after heater section for a solvent 50 as will be set forth more fully hereinafter. The upper, distillation section includes a plurality of frustoconical distributor rings 44 mounted on the external surface of flue 34. Each of distributor rings 44 serves as a serial catchment basin for solution introduced through inlet 48. The incoming solution is distributed over the external surface of flue 34 by passing downwardly and serially to the next succeeding distributor ring 44 through a plurality of apertures 46 adjacent flue 34. In this manner, thermal energy is efficiently transferred into the solution 51 to thereby vaporize the working fluid therefrom. Vaporized working fluid passes upwardly through cylindrical column 30 and through check valve 58 where it is introduced by conduit 59 into the countercurrent heat exchange apparatus of superheater 14.

After passing serially through each of distributor rings 44, the working fluid is substantially vaporized from solution 51 so that the residual liquid becomes relatively pure solvent 50. Solvent 50 collects as a pool in the after heater section of the base of distiller 12. The lower end of flue 34 is surrounded in heat exchange relationship with a coil 54 of tubing having an inlet 52 therein. Solvent 50 from adjacent the lower end of distiller 12 is drawn through coils 54 in heat exchange relationship with the lower end of flue 34 prior to being directed by conduit 56 into countercurrent heat exchanger 60. It should be noted that additional heat energy is imparted to solvent 50 by the use of heat exchange coils 54 so that solvent 50 is not only cooled in countercurrent heat exchanger 60 but transfers that heat energy to solution 51 passing upwardly through conduit 48 prior to introduction into distiller 12. Solvent 50 is then controlled by valve 24 and introduced by inlet 57 into the upper end of the absorption column 20.

With particular reference also to FIG. 2, superheater 14 is configurated as a generally cylindrical column 62 surrounded by an insulative layer 64 and includes a coaxial flue 66 extending upwardly therethrough in spaced relationship to column 62. A combustion chamber 70 includes a burner 72 and is interconnected to flue 66 so that the heat energy produced therein, indicated schematically by flames 74, passes upwardly through flue 66 and is exhausted as cooled exhaust 76. The annular space between flue 66 and cylindrical shell 62 is transected by a plurality of annular disks 68 having apertures 69 therein. Disks 68 serve as heat transfer fins for transferring heat energy from flue 66 into the working fluid vapor in the surrounding annular space. Apertures 69 causes thorough mixing and intimate heat exchange contact between the working fluid vapor and disks 68 in its passage downwardly through superheater 14 to exit conduit 78. In this manner, additional heat energy is imparted to the working fluid by superheater 14 thereby increasing the efficiency of the mechanical expansion engine through which the working fluid is passed.

Control valve 26 is operated by controller 27 and controls the introduction of high-pressure, high temperature working fluid vapor into mechanical expansion engine 16. Mechanical expansion engine 16 is configurated as a conventional mechanical expansion engine, preferrably in the form of a turbine, or the like and converts the thermal energy of working fluid vapor into mechanical energy. The mechanical energy is then transmitted to a generator 18 by means of a flexible belt 28 cooperating between sheaves 17 and 19. Generator 18, in turn, converts the mechanical energy into electrical energy. However, other conventional devices may be incorporated for the purpose of utilizing the mechanical energy developed by mechanical expansion engine 16.

Downstream of mechanical expansion engine 16 the working fluid exhausted therefrom is directed by a plenum 79 into an absorption column 20. In particular, plenum 79 extends downwardly into absorption column 20 as a coaxial, perforated cylinder having a plurality of apertures 81. The perforated column of plenum 79 is spaced from the internal wall of the cylindrical column 82 of absorption column 20 and the annular space thereabout is filled with a heat exchange coil 84 extending between an inlet 92 and outlet 90. The upper end of absorption column 82 includes a distributor screen 86 having a plurality of holes 87 for the purpose of distributing solvent 50 downwardly over heat exchange coils 84. The downwardly passing solvent combines with working fluid vapor passing through apertures 81 to create the solution 51. Thereafter, solution 51 is withdrawn through conduit 47 and pumped by high pressure pump 22 through countercurrent heat exchanger 60 prior to being introduced through inlet 48 into distiller 12.

The heat of absorption generated by the foregoing absorption process is recovered by being transferred to fluid passing through heat exchange coils 84. For example, a cold, coolant 93 is introduced through inlet 92 and is withdrawn therefrom as a heated coolant 91 through outlet 90. Advantageously, the recovered heat of absorption carried by heated coolant 91 may be utilized as a heat source for any suitable process or apparatus (not shown).

Countercurrent heat exchanger 60 is used to transfer heat energy from the relatively hot solvent 50 from the after heater section of distiller 12 into the relatively cool solution 51 from absorption column 20 thereby providing a relatively cool solvent for introduction into the upper end of absorption column 20. Correspondingly, the resulting, relatively hot solution 51 is introduced through inlet 48 into distiller 12. In this manner, less thermal energy is required by distiller 12 to produce the working fluid vapor. Additionally, a substantially lower backpressure is provided in absorption column 20 since the incoming solvent through inlet 57 is substantially reduced in temperature. Importantly, additional efficiencies are obtained by cooling the resulting solution 51 which, in turn, contributes greatly to the cooling of incoming solvent 50 in countercurrent heat exchanger 60.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a U.S. Letters Patent is:

1. A closed cycle, vapor standard engine comprising:

a closed cycle system comprising a first, working fluid having a first, lower boiling point and a second, solvent fluid having a second, higher boiling point, said second fluid having a relatively high degree of absorptivity for the first fluid;

distillation means for separating the first fluid from the second fluid by selectively vaporizing the first fluid with heat energy from a first external combustion source, the distillation means comprising a cylindrical column having a coaxial flue in spaced relationship in the column, the column being segregated into an upper, distillation section and a lower, heater section, the upper, distillation section including a plurality of frustoconical distributor rings mounted to the flue with each distributor ring serving as a catchment basin for fluid, and an after heater for said second fluid comprising a heat exchange coil having an inlet immersed in the second fluid in the lower, heater section, the coil being wound around the flue in heat exchange relationship therewith;

superheater means for superheating the vaporized first fluid with heat energy from a second external combustion source;

mechanical expansion engine means downstream of the superheater means, the mechanical expansion engine means converting thermal energy of the first fluid into mechanical energy; and an externally cooled absorption means downstream of the mechanical expansion engine means, the absorption means providing absorption of the first fluid from the mechanical expansion engine means with the second fluid thereby reducing backpressure in the first fluid, the absorbed first fluid in the second fluid comprising a third, solution fluid.

2. The closed cycle, vapor standard engine defined in claim 1 wherein the absorption means further comprises a cylindrical column with a coaxial, hollow cylinder and a plurality of apertures in the hollow cylinder, the hollow cylinder introducing the first fluid into the column with the apertures introducing the first fluid into the second fluid and heat exchange means for absorbing heat of absorption produced when the first fluid is absorbed by the second fluid, the heat exchange means comprising heat exchange means for conducting an external fluid in heat exchange relationship with the solution.

3. The closed cycle, vapor standard engine defined in claim 1 wherein the absorption apparatus further comprises a countercurrent heat exchanger for cooling incoming solvent to the absorption means with cooled solution produced in the absorption means, the cooled solution being heated by the solvent and thereafter returned to the distiller, thereby increasing the thermal efficiency of the distiller.

4. A method for converting thermal energy into mechanical energy comprising:

obtaining a dual fluid system comprising a first fluid having a relatively lower boiling point as a working fluid and a second fluid having a relatively higher boiling point as a solvent for the first fluid, the second fluid having a relatively high degree of absorptivity for the first fluid, the combined first fluid and second fluid forming a third fluid solution;

enclosing the dual fluid system within a closed system comprising a first, external combustion source, a distiller, a second, external combustion source, a superheater, a mechanical expansion engine means, an absorption column, and a heat exchanger, the distiller comprising a cylindrical column and a coaxial flue in spaced relationship to the column, the flue conducting heat energy through the column from the first external combustion source, the flue further comprising a plurality of frustoconical distributor rings for distributing the third solution over the flue to separate the first fluid from the second fluid with heat energy from the first, external combustion source, the absorption column comprising a cylindrical column with a coaxial, hollow cylinder and a plurality of apertures in the hollow cylinder, the hollow cylinder introducing the first fluid into the column with the apertures introducing the first fluid into the second fluid;

distilling the third fluid in the distiller means by distributing the third fluid over the surface of the flue with the distributor rings to absorb heat energy from the first, external combustion source thereby separating the first fluid from the second fluid and creating a working fluid with the first fluid;

superheating the working fluid in the superheater means with heat energy from the second, external combustion source;

converting thermal energy in the working fluid into mechanical energy by passing the working fluid through the mechanical expansion engine means; and absorbing the working fluid from the mechanical expansion engine means with solvent from the distiller by introducing the working fluid into the solvent through the apertures thereby increasing the efficiency of the mechanical engine expansion means by reducing the backpressure thereto, the absorbing step further comprising increasing the efficiency of the absorption means by cooling solvent from the distillation means with cooled solution from the absorption means and correspondingly increasing the efficiency of the distiller means by heating the solution prior to introducing the same into the distiller means in the heat exchange means, the heating step further comprising passing the solvent through an after heater in the distiller prior to passing the solvent through the heat exchange means, the after heater comprising a heat exchange tube coiled around the lower end of the flue, the tube having an open end immersed in the solvent in the bottom of the distiller, the open end drawing in solvent and conducting the solvent in heat exchange relationship with the flue.

5. The method defined in claim 4 wherein the absorbing step further comprises increasing the efficiency of the absorber means by externally cooling the absorber means by removing heat of absorption produced upon absorbing the working fluid in the solvent.

* * * * *

UNITED STATES PATENT AND TRADEMARK OFFICE

CERTIFICATE OF CORRECTION

PATENT NO. : 4,307,572
DATED : December 29, 1981
INVENTOR(S) : VerDon C. Brinkerhoff It is certified that error appears in the above-identified patent and that said Letters Patent are hereby corrected as shown below:

In the Abstract, line 17, "engine" (second occurrence) should be --energy--.

Signed and Sealed this

*Twenty-seventh* Day of *April 1982*

|SEAL|

*Attest:*

GERALD J. MOSSINGHOFF

*Attesting Officer*

*Commissioner of Patents and Trademarks*